United States Patent [19]

Fixler

[11] 4,418,243

[45] Nov. 29, 1983

[54] ACOUSTIC PROJECTION STEREOPHONIC SYSTEM

[75] Inventor: Jon S. Fixler, Andalusia, Pa.

[73] Assignee: Robert Genin, Miami, Fla.

[21] Appl. No.: 349,380

[22] Filed: Feb. 16, 1982

[51] Int. Cl.[3] ..... H04R 5/02

[52] U.S. Cl. ..... 381/24; 179/146 E; 181/144

[58] Field of Search ..... 179/1 E, 1 G, 1 GA, 179/1 GQ; 181/144

[56] References Cited

U.S. PATENT DOCUMENTS

| | | | |
|---|---|---|---|
| 3,478,167 | 11/1969 | Sorkin | 179/1 G |
| 3,637,938 | 1/1972 | Kuhlow et al. | 179/1 E X |
| 4,179,585 | 12/1979 | Herrenschmidt | 179/1 E |
| 4,249,037 | 2/1981 | Dexter | 179/1 GA |
| 4,256,922 | 3/1981 | Gorike | 181/144 X |

FOREIGN PATENT DOCUMENTS

| | | | |
|---|---|---|---|
| 2037130A | 7/1980 | United Kingdom | 179/1 GA |

OTHER PUBLICATIONS

"The Trimensional Stereo Speaker System", Brociner, Audio Mag., 6/1959, pp. 21-23 & 76.

*Primary Examiner*—R. J. Hickey
*Attorney, Agent, or Firm*—Michael Ebert

[57] ABSTRACT

An acoustic projection system in which a reproducer array disposed in a listening chamber and operating in conjunction with a signal processor coupled to right and left channels carrying stereophonic signals, acts to project sound into the chamber in a manner substantially recreating the three-dimensional ambience of an original sound source composed of a central zone flanked by left and right zones. The processor extracts from the two channels a first power output derived from the sum of the right and left channel signals, a second power output derived from the difference between the left and right channel signals, and a third power output derived from the difference between the right and left channel signals. The array is constituted by a middle driver energized by the first output to radiate toward the front and rear of the listening chamber sounds representing all zones of the original sound source, a left driver energized by the second output to laterally radiate toward one side sounds representing the difference between the left and right zones, and a right driver energized by the third output to laterally radiate toward other side sounds representing the difference between the right and left zones whereby the resultant sound image to which a listener in the front area of the listening chamber is exposed includes sonic components which are time displaced with respect to the sonic components projected toward the front to provide spatial clues which impart a three-dimensional aspect to the reproduced sounds.

8 Claims, 6 Drawing Figures

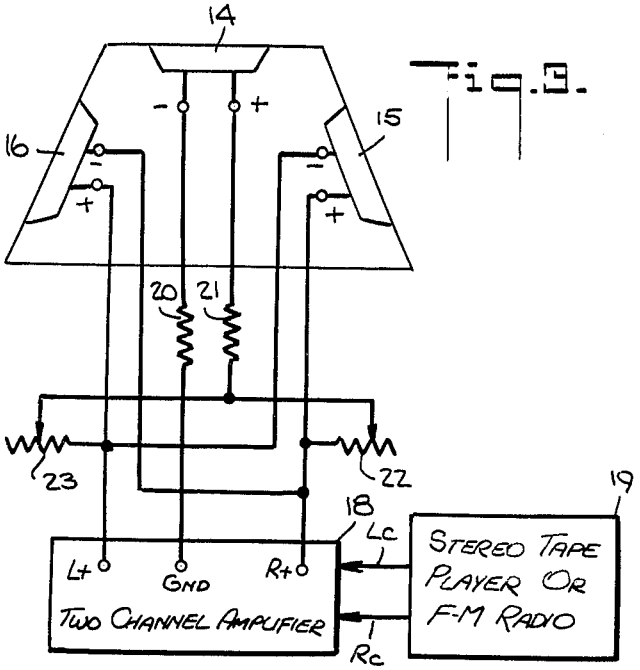
Fig. 3.
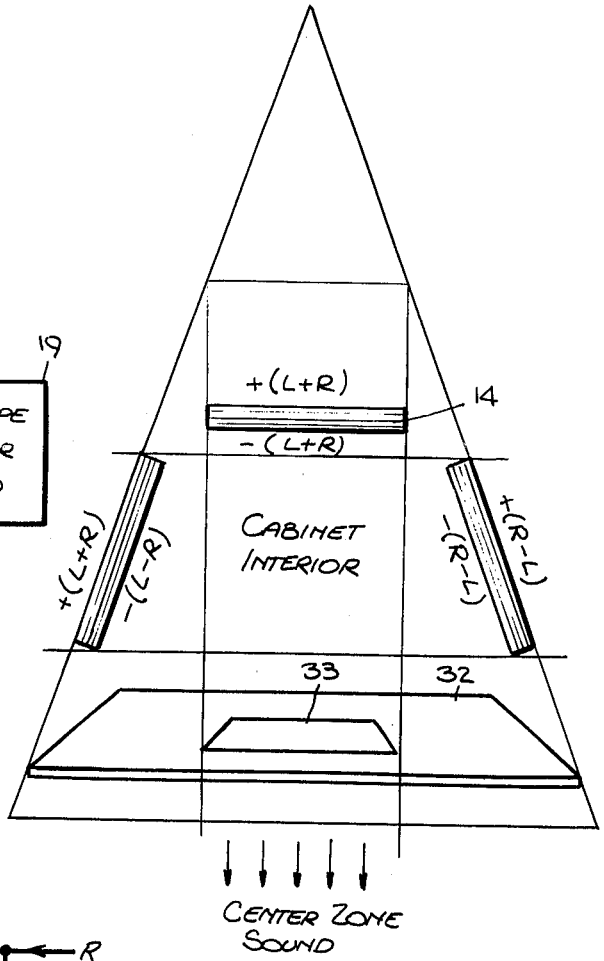
Fig. 6.
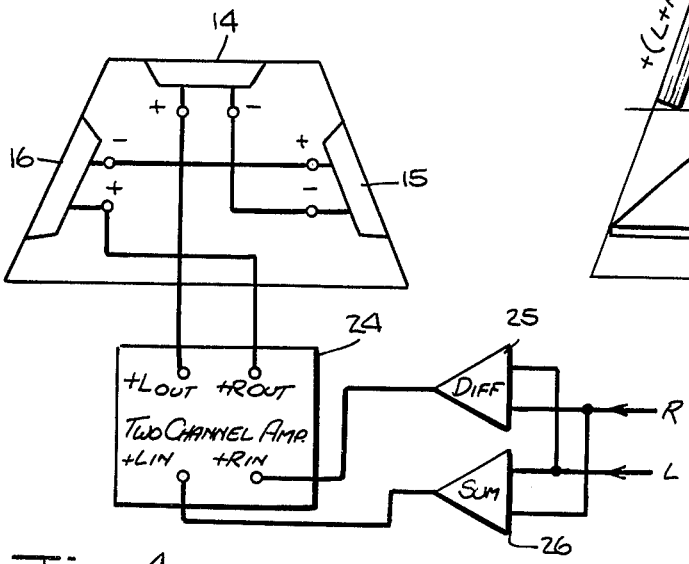
Fig. 4.
Fig. 5.
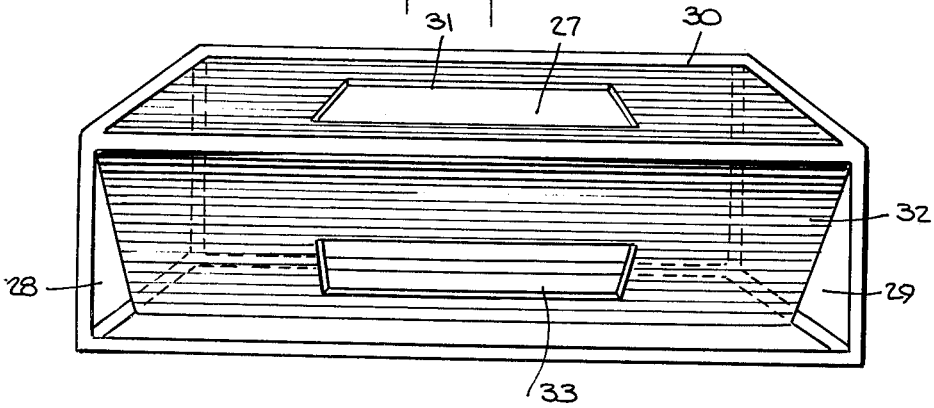

ACOUSTIC PROJECTION STEREOPHONIC SYSTEM

BACKGROUND OF THE INVENTION

Field of Invention

This invention relates generally to stereophonic reproduction, and more particularly to an acoustic projection system in which a reproducer array operating in conjunction with a signal processor coupled to the stereophonic signal channels acoustically radiates sounds in a manner exposing the listener, almost without regard to his position relative to the array, to a sound-image substantially recreating the three-dimensional ambience of the original sound source.

The principles underlying stereophonic sound are comparable to those involved in stereovision, for just as a scene is perceived by two spatially-separated eyes to produce a disparity in the resultant retinal images, sound from a source is sensed by spaced-apart ears, as a result of which the sounds entering the ears differ somewhat in their intensity, time of arrival and phase, thereby giving rise to disparate aural impressions.

While it is possible to faithfully create stereoscopic images, modern stereophonic sound reproduction is a misnomer despite its high level of technological sophistication, for the reproduced sound is lacking in depth or presence and is not truly three-dimensional. In order therefore to understand the deficiencies of present day stereophonic reproduction, one must first analyze the essential nature of stereovision.

The British scientist, Charles Wheatstone, in a paper published in 1883, not only set forth the general theory of binocular vision, but in the same paper suggested a method of devising a stereoscope. As Wheatstone pointed out, when a single eye is directed toward an object such as a sphere of a given size, the brain may then interpret the retinal image of this object either as one that is large but far away, or one that is near but small. When however, the observer looks at this object with both eyes, it becomes fixed in direction, size, shape and distance, the object then being perceived in three-dimensions. Depth is therefore an indispensable component of stereovision.

The axes of the two eyes of the observer form an angle known as the ocular parallax, the eyes seeing slightly different images. Yet the disparity in the two retinal images does not result in blurring or confusion, for the brain in a manner not fully understood, compares and combines the two separate sets of sensations to gain a three-dimensional perception of the object. Stereoscopic depth judgments are remarkably precise, consistent with the finding that all but the smallest eye movements and accommodative adjustments are highly correlated between the two eyes, and the neural units in the visual brain are precisely connected by way of intermediate synapses to optically corresponding areas.

In a stereoscopic camera, use is made of two lenses separated by 6.5 cm, this being the mean interocular distance. In stereoscopic motion pictures, the separate pictures recorded with a two-lens camera are cast on the same screen through projection lenses covered by a pair of Polaroid discs whose axes are perpendicular to one another, so that the projected pictures are polarized differently. The viewer looks at this screen through glasses fitted with a second set of Polaroid discs, also oriented with their axes at right angles. Thus one eye of the viewer sees one "flat" picture and the other a second "flat" picture. Simultaneous perception of the two different flat pictures by the eyes yields the desired depth or three-dimensional visual effect.

For a stereoscopic system to function at all, it is vital that there exist mutually exclusive eye images of the two "flat" pictures. Whether such exclusion is effected by geometric optics, color optics or polarization, visual intermingling the two pictures must scrupulously be avoided.

In listening with both ears to an orchestra whose instrumentalists are dispersed, the brain sorts out differences in the sounds picked up by the ears so that the listener not only senses the directions from which the various sounds come, but also the relative positions of the instrumentalists. Hence normal hearing as well as seeing involves the sensation of perspective or depth.

The ability to localize the direction of a sound source depends to a degree on the facility of the human auditory system to recognize differences in loudness or sound intensity, as well as differences in phase and in the quality of sounds when they are complex. Localization of sounds by the auditory system is also a function of sound frequency. Thus the ability of the human auditory system to localize the direction of sound produced by loudspeakers is relatively poor in the low end of the audio range (i.e., up to 400 Hz). Between 400 and 1000 Hz, sound sources are localized by detecting phase differences in the sounds reaching the ears; while above 1000 Hz, one depends mainly on differences in the loudness of the sounds reaching the ears (See *Electronic Engineers' Handbook*—D. G. Fink—McGraw-Hill, 1st Edition).

If, therefore, one listens to a live radio broadcast or to a recording of an orchestra through a single loudspeaker, all sounds will then issue from the direction of the speaker regardless of the placement of the microphone or microphones picking up the original orchestra sounds. Consequently, the reproduced sounds will be altogether lacking in directionality, to say nothing of depth.

Stereophony is generally thought to be a recent technological innovation. But the fact is that stereophony can be traced back to Clement Ader who in 1881 demonstrated at an International Exhibition of Electricity in Paris the first binaural telephone—linked system in which a performance at the Paris opera was transmitted over two channels to listeners at the exhibition. (See J. Audio Eng. Soc.—May, 1981—"100 Years with Stereo—The Beginning").

In a typical modern stereophonic system for broadcasting or recording an orchestra, two microphones are placed at left and right sites relative to the sound source, and the microphone signals are conveyed through left and right channels to maintain a separation therebetween. By reproducing the channel outputs through two loudspeakers placed reasonably far apart at left and right positions, the listener, if properly situated relative to the speakers, will interpret the speaker sounds as coming from directions that depend on the position of the orchestral instruments relative to the two microphones.

Throughout this specification, an original source such as an orchestra will be divided into a middle or central zone flanked by left and right zones. Sound emanating from these zones are three-dimensional, for the instrumentalists are not positioned along a common line but are dispersed, and the sounds heard include those reflected from the surfaces of the performing chamber as well as directly from the players. The left and right microphones are adjacent the left and right zones and therefore are more immediately responsive to the sounds therefrom than sounds which both microphones later pick up from the central zone. By "more immediately responsive" is meant that the sounds from the left and right zones reach the microphones sooner than the sounds from the central zone.

In conventional two-channel reproduction, the sound images are localized between the left and right loudspeakers. One problem often encountered with this arrangement is the so-called "hole-in-the-middle" effect, by which is meant that while the listener hears sound which appears to come from the left and right zones of the orchestra, the body thereof or the central zone appears to be vacant. To overcome this effect, it is sometimes the practice to insert a mixing bridge between the two amplifier channels feeding the loudspeakers. And while this fills in the hole, it does so at the expense of directionality.

The illusion of dimensionality obtained with conventional two-speaker stereophonic reproduction is a far cry from an authentic stereophonic experience if by stereophonic one means the creation of sound-image analagous to stereovision in which the sounds are three-dimensional and do not give a "flat" aural impression. In its existing form, two-channel reproduction affords no genuine sense of depth, for sounds emanating from the right and left speakers are intermingled in the listening environment and are heard by both ears.

Ideally, the listening post with a two-speaker arrangement should be equidistant from the left and right speakers, in which event the left and right ears and the left and right speakers are in a symmetrical pattern. Though the ears are then sensitive to the direction of the sound and there is an increased clarity of inner melodic voices, because of environmental mixing there is no genuine sensation of depth. And when the listener moves away from this ideal listening post, the directional effect is impaired.

In the article "Controlling Sound-Image Localization in Stereophonic Reproduction" Sakamao, et al.—(J. Audio Eng. Soc.—November 1981) there is disclosed a system for controlling sound image localization in all directions around a listener by inserting in the signal channels to the loudspeakers, two networks, one of which produces a ratio of the signals between the channels and the other a signal common to both channels. But this arrangement does not impart depth to the sound image.

The section "Stereophony" in the Encyclopedia of Physics—R. M. Beancon—Reinhold Publishing, describes a conventional stereophonic system having left and right speakers. It is noted in this section that "the ability of the listener to determine the apparent positions of different musical instruments is a less important part of the stereo effect". Yet what this text treats as of lesser importance, actually is the crucial feature of a true stereo effect, for when the sound-image received by the listener gives no aural impression of depth and the apparent position of the different musical instruments cannot be sensed, this is no better than a "flat" picture.

Another significant factor that existing stereo systems fail to take into account is the distinction between what a listener hears at a live concert without the intervention of electronics, and what he hears in a stereo-reproduced situation. At the live concert, the listener, who we shall assume is seated at about the center of the auditorium with the orchestra playing on stage, will hear sounds from the middle zone before hearing sounds from the left and right zones, for the distance between the listener and the middle zone is shorter. But with a stereo system in which microphones are set up at left and right sites in the same auditorium, with correspondingly-positioned loudspeakers in the listening chamber, the sonic situation is reversed, for the reproduced sounds first heard by the listener are those originating closest to the microphones, these left and right zone sounds being succeeded by those originating from other points.

The problem of electronically recreating realistic sound is aggravated by the manner in which many recordings are currently made. A small orchestra or band is usually recorded in a relatively small studio lacking in ambience. A separate microphone is assigned to each instrument, each microphone signal being recorded on a separate magnetic track. Thus a ten piece band is recorded in the studio on ten distinct tracks. In transferring this multitrack recording to a two channel tape, equalizers and mixers are used to create a recording in which the instruments are balanced and properly placed with respect to left and right of center. The net result of the multi-track recording technique is entirely synthetic in sonic terms, for despite the complexity of the electronic paraphenalia involved, there is a total loss of the essential timing, amplitude and spatial clues present in a live listening experience.

SUMMARY OF THE INVENTION

In view of the foregoing, the main object of this invention is to provide an acoustic projection system which when associated with channels carrying stereophonic signals, acts to radiate sound in a manner substantially recreating the natural three-dimensional ambience of the original sound source from which the signals are derived.

More particularly, an object of the invention is to provide a system of the above-type having a reproducer array operating in conjuction with a signal processor coupled to the channels to extract power outputs therefrom for energizing the drivers of the array to project sounds in directions producing a three-dimensional sound-image, which image remains effective almost without regard to the position of a listener with respect to the array.

A significant feature of the invention is that the reproducer array may be realized in a highly compact unitary assembly without sacrificing the three-dimensional effect, thereby obviating the need for widely separated left and right loudspeakers. Thus it becomes possible to incorporate an assembly in accordance with the invention in F-M radio receivers, T-V sets, stereo tape and disc players, and all other forms of stereophonic reproduction devices to create realistic spatial sound effects not heretofore attainable with conventional stereophonic speaker arrangements.

Also an object of the invention is to provide an acoustic projection system which when used with a monaural signal channel or a monaural radio receiver, acts to simulate aural depth.

Yet another object of the invention is to provide an acoustic projection system which operates reliably and efficiently and which lends itself to low-cost manufacture.

Briefly stated, these objects are attained by an acoustic projection system in which a reproducer array disposed in a listening chamber and operating in conjunction with a signal processor coupled to the channels carrying stereophonic signals, acts to project sound into the chamber in a manner substantially recreating the three-dimensional ambience of an original sound source composed of a central zone flanked by left and right zones. The processor extracts from the two channels a first power output derived from the sum of the right and left channel signals, a second power output derived from the difference between the left and right channel signals, and a third power output derived from the difference between the right and left channel signals. The array is constituted by a middle driver energized by the first output to radiate toward the front and rear of the listening chamber sounds representing all zones of the original sound source, a left driver energized by the second output to laterally radiate toward one side, sounds representing the difference between the left and right zones and a right driver energized by the third output to laterally radiate toward the other side, sounds representing the difference between the right and left zones whereby the resultant sound image to which a listener in the front area of the listening chamber is exposed includes sonic components which are time displaced with respect to the sonic components projected toward the front to provide spatial clues which impart a three-dimensional aspect to the reproduced sounds.

OUTLINE OF DRAWINGS

For a better understanding of the invention as well as other objects and further features thereof, reference is made to the following detailed description to be read in conjunction with the accompanying drawings, wherein:

FIG. 1 schematically illustrates the relationship between an orchestral sound source in which instrumentalists occupy dispersed positions on a stage and microphones located in an auditorium at left and right positions;

FIG. 3 is the circuitry of a signal processor for inclusion at the high level end of a two-channel stereo amplifier;

FIG. 4 is the circuit of a signal processor for inclusion at the low level end of a two channel stereo amplifier;

FIG. 5 is a preferred form of baffled cabinet assembly for the reproducer array; and FIG. 6 is a diagram which explains the action of the baffle arrangement.

DESCRIPTION OF THE INVENTION

Basic Principles

Figure 1:
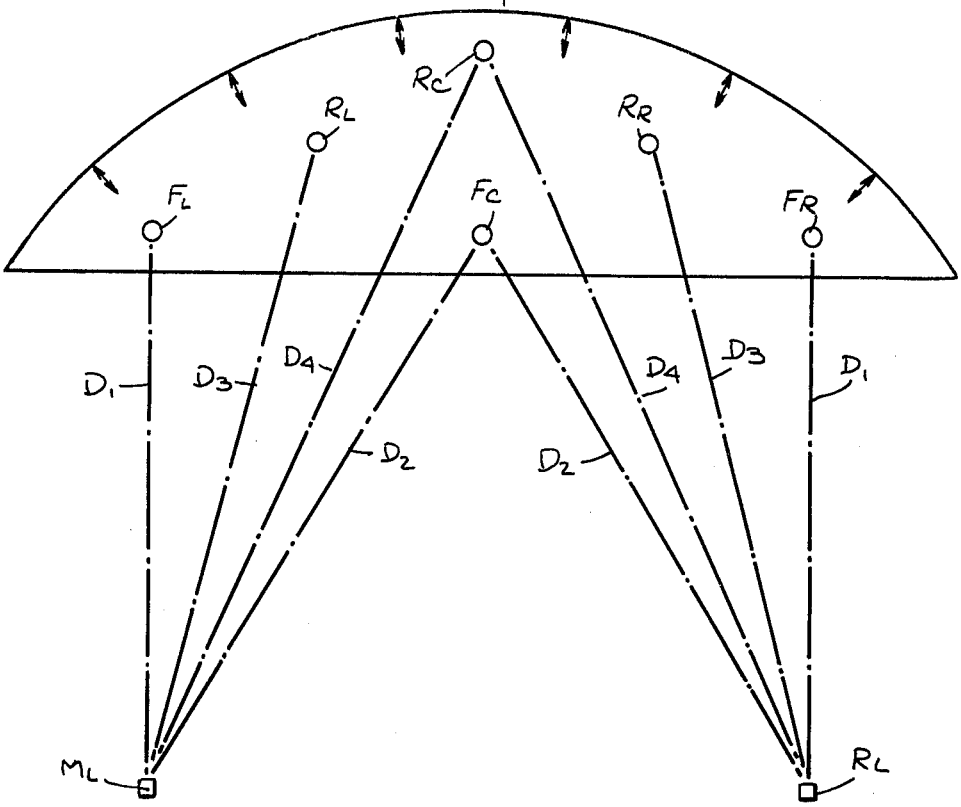

Referring now to FIG. 1, there is schematically shown a stage 10 having a curved acoustic shell 11. Playing on stage 10 is an orchestra constituted by a front center play $F_c$ flanked by front left and front right players $F_l$ and $F_r$, as well as rear center, rear left and rear right players $R_c$ $R_l$ and $R_r$. Installed at appropriate sites in the auditorium are left and right microphones $M_l$ and $R_r$ in line respectively with the front left and front right players. Thus players $F_c$ and $R_c$ are in the central zone of the sound source, player $F_l$ and $R_l$ in the left zone and players $F_r$ and $R_r$ in the right zone. The distance $D_1$ between the respective microphones and the right and left front players $F_l$ and $F_r$ are identical; hence it takes exactly the same time for sound to travel from player $F_l$ to microphone $M_l$ as it takes from sound to go from player $F_r$ to microphone $M_r$.

The speed of sound in air under standard conditions of temperature and atmospheric pressure is 1087 feet per second. Microphones $M_l$ and $M_r$ are equidistant from front center player $F_c$. This distance represented by $D_2$ is slightly longer than distance $D_1$; hence it takes a small fraction of a second longer for sound from player $F_c$ to reach the microphones. Still longer is the distance $D_3$ between left microphone $M_l$ and rear left player $R_l$, the same distance extending between this player and right microphone $M_r$, so that the arrival time of sound from this source is still later. And the distance $D_4$ between rear center player $R_c$ and both microphones is greatest of all so that sound from this source is the last to arrive.

The times of arrival referred to in the foregoing are with respect to sound going directly from the players to the microphones in the central and left and right zones. But since the sounds emanating from the various instrumentalists also travel to the acoustic shell and are reflected thereby toward the microphones, still longer travel times are entailed for these indirect sounds.

In listening to an orchestra in a live concert with both ears, one is not only able to detect the direction from which the sounds are coming but also to discriminate between the relative positions of the players in the various zones in terms of depth. The brain which digests aural data derived from both ears is responsive not only to differences in amplitude from sounds arriving from different directions but also to time displacements therebetween, these displacements providing as it were "spatial clues".

Regardless of the size of the hall and his seating position therein, the sound-image created in the mind of the listener is three-dimensional in scope and is therefore accompanied by a sense of presence, depth or ambience. Though a listener in the absence of a clear view of the orchestra may find it difficult, purely on the basis of sound, to determine the right or left orientation of a particular instrumentalist, he can almost invariably tell whether one instrument is closer to him than another.

The reason existing loudspeaker arrangements for stereophonic two-channel reproduction though providing directional sounds when the listener is properly positioned with respect to the speakers, fail to create three-dimensional spatial effects is that the sounds do not supply to the listener spatial clues making it possible for his brain to impart depth to the received aural impressions.

The present invention is directed to a reproducer array which operates in conjunction with a signal processor coupled to left and right channels carrying standard stereophonic signals and so projects sounds as to supply spatial clues to a listener which when digested by the brain imparts a sense of depth to the listening experience without requiring that the listener occupy a particular position with respect to the array.

The theoretical foundation for the invention is the hypothesis that in order for the brain to process visual or aural information so as to derive therefrom visual or aural images creating a sense of depth, the incoming data must be compared with reference data. A real sound source generates two sets of information, the primary set being resolvable and the secondary set being time displayed and therefore spatially distinguishable from the primary information.

In the act of listening, one can resolve a signal that arrives at both ears with the identical amplitude and phase. This experience is analogous to visual information seen by both eyes and on which both eyes can focus and therefore resolve. In the case of optics, the second set of information cannot be resolvable or in focus, yet it is essential, for it serves as a reference set for depth discrimination. The unfocused information set must however fall into an acceptable time frame following the arrival of the first resolvable set. Within certain limits, the greater the time displacement between the two sets of information, the greater the perceived depths. The actual time parameters are determined by the brain's ability to store the first set of information, for comparison with the second or reference set.

In an acoustic projection system in accordance with the invention, the reproducer array is energized through a signal processor coupled to the left and right channels carrying stereo signals to produce power outputs energizing the drivers of the array to radiate sounds in a manner generating a sound image in the listening area in which sounds emanating from the central zone of the original sound source are heard at a point in time slightly in advance of sounds emanating from the left and right zones thereof, thereby reversing the timing relationship of these sounds as picked up by the left and right microphones and effectively restoring the normal relationship which exists between a listener and the original sound source at a live concert.

The time displacement produced by an acoustic projection system in accordance with the invention does more than restore the normal relationship between the listener and the original sound source, for it also functions to impart depth and presence to the resultant sound-image to thereby recreate the ambience of the original performance.

THE BASIC SYSTEM

Figure 2:
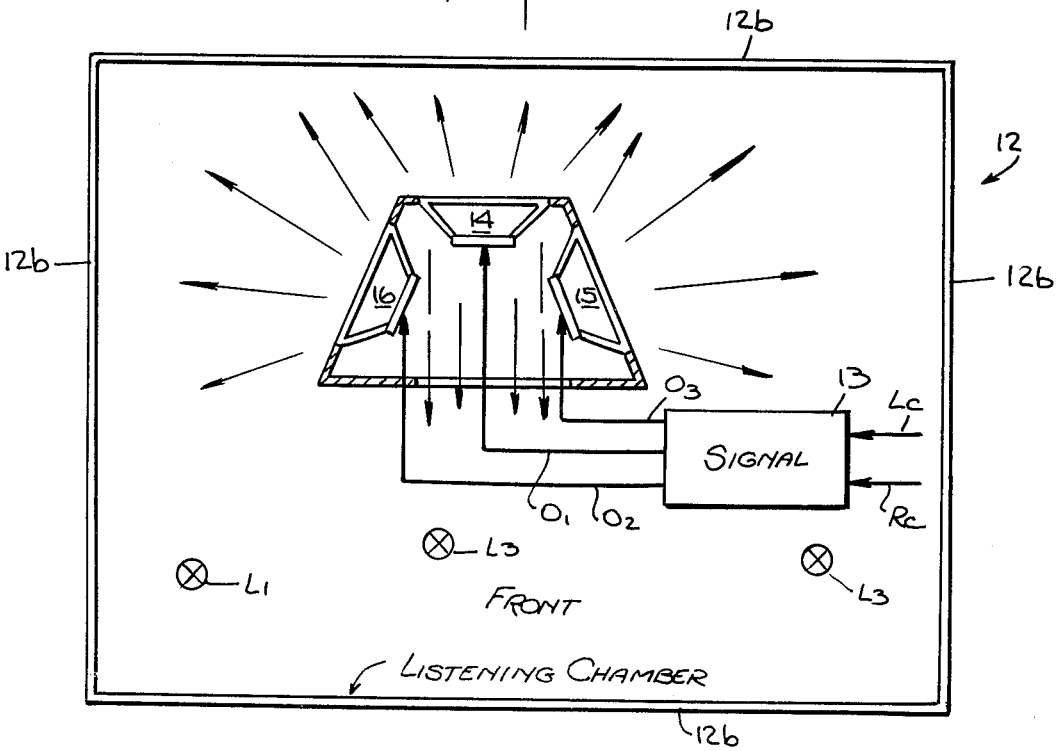
FIG. 2 shows the basic components of an acoustic projection system in accordance with the invention.

Referring now to FIG. 2, there is shown an acoustic stereophonic projection system in accordance with the invention installed in a room or listening chamber 12 having back and front walls $\mathbf{12}_b$ and $\mathbf{12}_f$ and left and right side walls $\mathbf{12}_l$ and $\mathbf{12}_r$. The room also includes a ceiling and floor (not represented).

The system comprises a reproducer assembly, generally designated RA and a signal processor 13. In the assembly, there is an array of three loudspeakers or drivers 14, 15 and 16 which are mounted within a cabinet 17 having a trapezoidal cross-section. The drivers may be standard, high quality cone-type permanent magnet dynamic speakers. In practice, other types of polarized speakers may be used, such as piezoelectric transducers.

Driver 14 is mounted on the rear side of cabinet 17 whose front side is ported so that sound radiating from the front of the cone is projected toward the back wall $\mathbf{12}_b$ of the room, while sound radiating from the rear of the cone is projected toward front wall $\mathbf{12}_f$. We shall assume the presence of listeners $L_1$, $L_2$ and $L_3$ in the front area of the room at various positions between the assembly and the front wall $\mathbf{12}_b$.

Driver 15 is mounted on the inclined right side of cabinet 17 so that its cone radiates sound laterally toward the right wall $\mathbf{12}_r$ of the room, driver 16 being mounted on the inclined left side so that its cone radiates sound laterally toward the left wall $\mathbf{12}_l$.

Signal processor 13 is coupled to the left and right channels LC and RC of a conventional stereophonic system, the processor acting to derive three outputs from the signals carried by the channels. One power output $O_1$ is derived from the sum of the signals carried by both channels. Since these are obtained by left and right-oriented microphones, the sum of these signals represent the full sound content of the original source from all zones thereof. For purposes of explanation, we shall assume that the original source is an orchestra, as shown in FIG. 1, whose instrumentalists are dispersed on a stage, and that the full sound content is composed of the sounds picked up by the microphones from the left and right zones of the stage as well as from the central zone thereof. Output $O_1$ is applied to energize middle driver 14, hence what is projected to the rear of the room is the full sound content of the orchestra without directional discrimination.

The second power output $O_2$ yielded by the processor is derived from the difference between the left and right channel signals. The obtain this difference, the left and right channel signals are applied to left driver 16 in polar opposition. In order to explain the effect of this action we must first point out that when two a-c voltages having identical amplitudes and frequencies are applied in phase opposition to a load, the voltage developed thereacross will then be zero, for the applied voltages are then of equal amplitude and opposite phase and cancel out. If however, the applied voltages differ in amplitude or phase, the resultant voltage developed across the load will have a value that depends on the disparity therebetween.

In FIG. 1 it will be seen that the left and right microphones $M_l$ and $M_r$ are closest respectively to the left and right zones of the orchestra and that they are equidistant from the central zone thereof. Consequently, the left side microphone produces signals whose amplitude is greatest with respect to sounds originating from the left zone of the orchestra, the amplitude diminishing with respect to sounds from the central zone and being lower with respect to the right zone which is relatively remote from this microphone. Conversely, the right side microphone produces signals whose amplitude is greatest for sounds from the right zone and have a diminishing amplitude for sounds originating from the other zones.

On the other hand, both microphones are equidistant from the central zone of the orchestra and the microphone signals reflecting this region are of equal amplitude and phase. The distance between a microphone and a sound source not only determines the amplitude of the resultant signal but also its phase or timing relative to the timing of the sound wave at its point of origin.

Processor 13, to produce a second power output $O_2$, subtracts the signal from the right channel from the signal from the left channel (L−R) by applying these signals in polar opposition to energize the polarized left driver 16. Because the right and left channel signals include components derived by the microphones from the central zone of the source which are of like amplitude and phase, these cancel out on left driver 16. And because the signal component derived from the right zone is applied in a polarity opposed to that of the speaker, the speaker is responsive essentially to the component from the left zone and projects sounds stressing the left zone. In a similar manner, processor 13 produces a third power output $O_3$ by subtracting the signal from the left channel from the signal from the right channel (R−L) by applying these signals in polar opposition to energize the polarized right driver, the speaker projecting sounds stressing the right zone.

Thus listener $L_1$ in front of the reproducer assembly RA who hears the "sum" sounds coming from the open port at the front of the assembly, hears sounds representing the full content of the orchestra sound. He receives, as it were, a first set of sonic information which is resolvable by the brain, and this impression does not depend on where this listener is positioned in the front area of the room. The sonic data representing sounds originating at the right and left zones is received by listener $L_1$ after it is reflected from the side and back wall of the room as will as from the ceiling, and hence the time of arrival of these sounds is slightly displaced in time from the first set of sonic information and provides the necessary second set of data or reference with respect to the first set. This affords the aural brain the spatial clues from which it obtains the sensation of depth. All of the required spatial clues for depth perception are available to listeners $L_1$, $L_2$ and $L_3$ regardless of their positions in the front area of the room.

It is important to note that while the left and right microphones receive sounds from the left and right zones before sounds are picked up from the central zone of the orchestra, a reversal of the relationship existing when a listener hears a live orchestra, the acoustic projection system in accordance with the invention, by suppling the listener with sonic information from the central zone before he hears sounds from the left and right zones, restores the natural relationship of the listener to the orchestra.

And by effectively delaying the arrival of right and left zone sounds relative to the central zone sounds, spatial clues are provided to the listener for depth perception. In the arrangement shown in FIG. 2, it is the listening chamber in conjunction with speaker array that provides the necessary time displacement. The delay in this instance, depends on room parameters and speaker placement. In practice, the time delay may be introduced electronically by interposting adjustable time delay networks in the input circuits to the left and right drivers 16 and 15. In this way one can adjust the timing relationship between respective electrically reproduced zones so that they effectively recreate the relationship existing between this source and a listener without the intervention of electronics.

The invention is not limited to the continuous transmission of left and right channel signals. Thus conventional telephone lines may be used in conjunction with a multiplexing arrangement to commutate the application of right and left channel signals to the line at a cyclical rate whose frequency is above the normal audio range and therefore does not interfere with the line transmission or reception.

Existing forms of speaker phones leave much to be desired, for the sound heard by the subscriber through the speaker is excessively resonant or boomy and difficult to understand. But by having at each telephone transmitting station a pair of spaced microphones whose signals are applied by a multiplexer to the telephone line, and at each receiving station a multiplexer operating in synchronism with the transmitting multiplexer to feed the left and right signals to separate amplifying channels coupled to a three speaker array through a signal processor as described above, one can significantly improve the quality of telephone communication and produce a realistic ambience that enhances intelligibility rather than the present disturbing echo chamber effect.

SIGNAL PROCESSORS

Referring now to FIG. 3, there is shown a preferred embodiment of a signal processor for use in conjunction with drivers 14, 15 and 16 in the reproducer assembly RA, the processor in this instance being at the high level end of a two-channel stereo amplifier 18. The input to the amplifier is coupled to a stereo tape or disc player, or any other source of stereo signals represented by block 19. The output terminals are represented by terminal +L for the left signal channel, terminal +R for the right signal channel and terminal G for the ground common to both channels.

The left driver 16 and right driver 15 are connected in polar opposition to the +R and +L terminals so that the positive pole of right driver 15 is connected to +R and the positive pole of the left driver goes to +L, with the negative pole of the right driver being connected to +L and the negative pole of the left driver to +R. In this way, the left and right drivers are energized by the two amplifier channels so that the left driver has an L−R signal applied thereto and the right driver an R−L signal.

Middle driver 14 has its negative pole connected to the G terminal through a fixed resistor 20 and its positive pole connected through a fixed resistor 21 to the sliders of both a first potentiometer 22 and a second potentiometer 23. Potentiometer 22 is connected to +R and potentiometer 23 to +L. In this way the middle driver is energized by the sum of the left and right signals (L+R) to project the full content of the original sound source.

Adjustment of the potentiometers makes it possible to balance the relative amplitudes of the channel signals applied in additive relation to the middle driver. As pointed out previously, one may interpose adjustable time delay networks in the lines going to the left and right drivers to time-displace the sounds from these speakers with respect to those issuing from the middle speaker and to so adjust the time displacement as to create an ambience in the listening chamber matching that of the original sound source.

In the signal processor shown in FIG. 4, the processor operating in conjunction with a conventional two channel stereo amplifier 24 provides the required mixing at the low level end of the amplifier. Amplifier 24 has $+L_{in}$ and $+R_{in}$ input terminals and $+L_{out}$ and $+R_{out}$ output terminals. The incoming left and right signals L and R are applied to the input terminals through a differential amplifier 25 and a summing amplifier 26 so that applied to $+R_{in}$ is the ratio of L and R and to $+L_{in}$, the sum of L and R.

The sum signal yielded at $+L_{out}$ is applied to the positive pole of middle driver 14 whose negative pole goes to the negative pole of right driver 15. The positive pole of right driver 15 is connected to the negative pole of left driver 16 whose positive pole goes to $+R_{out}$. In this way, the ratio signal is applied in phase opposition to the left and right drivers while the sum signal to the middle driver, the projected acoustic effect being the same as attained with the FIG. 3 signal processor.

BAFFLED CABINET

Referring now to FIG. 5, there is shown a preferred form of cabinet for the three drivers in the array. The cabinet is in the form of a rectangular box in which middle speaker 14 is mounted on rear wall 27, the left speaker 16 on a left side wall 28 and the right speaker on right side wall 29. The cabinet is provided with a top wall baffle 30 having a center port 31 therein to permit sounds from the rear of the middle speaker cone to project upwardly toward the ceiling.

Also provided is an inclined front wall baffle 32 having a center port 33 therein to pass sounds forwardly from the rear of the middle speaker. This baffle arrangement enhances the separation of the projected sounds from the three zones.

The interaction of the drivers in the array within the cabinet results in acoustic projection through the center port 33 of the front wall baffle of sound mainly from the central zone of the original sound source, thereby liberating, as it were, the central zone sound from the sounds emanating from the left and right zones. The manner in which such liberation is effected will now be explained in connection with FIG. 6 which diagrammatically illustrates the acoustic relationship of the three drivers 14, 15 and 16 in the cabinet.

First, it must be noted that sounds radiated from the front of each driver cone is out of phase with sounds radiated from the rear thereof, this being true of all loudspeakers. Since middle driver 14 is energized by the first power ouput derived from the sum (L+R) of the channel signals, the sounds radiated from the front of this driver toward the rear of the listening chamber are represented by +(L+R), the sum of the two channel signals. The sounds radiated by the rear of middle driver 14 into the interior of the cabinet are therefore represented by −(L+R) which is out of phase with +(L+R).

Since the left driver 16 is energized by the second power output derived from the difference between the left and right channel signals (L−R), the sound radiated from the front of this driver toward one side of the chamber is represented by +(L−R) and from the rear thereof into the cabinet interior by −(L−R). And since the right driver 15 is energized by the third power output derived from the difference between the right and left channel signals (R−L), the sound radiated from the front of this driver toward the opposite side of the chamber is represented by +(R−L) and from the rear thereof into the cabinet interior by −(R−L).

Thus within the confines of the cabinet interior, the sounds radiated from the rears of the three drivers are represented by a mix of (L+R), (L−R) and (R−L). The sum or (L+R) sounds from the rear of the middle driver represent sounds derived from all zones in the original sound source; namely, the sounds from the central zone and as well as those from the left and right zones. The left and right microphones, as explained in connection with FIG. 1, each to the same degree pick up sounds emanating from the central zone, so that both the left and right channel sounds include a central zone component.

When the (L+R) sounds from the middle driver acoustically interact in the cabinet interior with the (L−R) sounds from the left driver, the −R and +R right zone sounds effectively cancel out acoustically. And when the (L+R) sounds from the middle driver acoustically interact in the cabinet interior with the (R−L) sounds from the right driver, the −L and +L left zone sounds effectively cancel out acoustically. However, the central zone sound component which is common to the left and right channels, does not balance out but is summed, the surviving central zone sounds being projected through the front port 33 into the area in front of the speaker cabinet in the listening chamber.

The cabinet baffling, therefore, in conjunction with the driver array acts to liberate the sounds from the central zone from the mix of sounds radiated from the rears of the drivers into the interior of the cabinet. As a consequence, the listener, whatever his post in front of the cabinet, first hears sounds from the central zone of the original sound source and then hears sounds from the other zones; for these other sounds are not directed toward the front area and only reach this area after reflection from the walls of the listening chamber.

Because of the acoustic displacements provided by the reproducing system which approach those encountered in a live concert, the listener is given spatial clues which impart a realistic three-dimensional aspect to the reproduced sound. The reproduced sounds thereby afford a sense of sonic depth lacking in the typical left and right speaker stereophonic arrangement. Hence a stereophonic reproducing system in accordance with the invention is no longer a misnomer, for the listener, as in an actual concert performance in which his ideal listening position in the auditorium or hall is centered with respect to the orchestra, the listener will first hear sounds from the central zone, for these reach his ears slightly before sounds arrive from the left and right zones.

The term "listening chamber" as used throughout this specification is intended to encompass any enclosure in which a reproducer array is disposed, such as a room, a hall or an auditorium. And while the stereophonic channels have been referred to in the specification as left and right signal channels, these terms are not limited to specific physical orientations but designate separated frist and second signal channels necessary to provide a sound-image having a depth dimension.

MODIFICATIONS

In the above-described triple driver cabinet arrangement, the sound projected toward the front of the listening area represents mainly the center zone of the original sound source, the left and right zones being effectively excluded therefrom. This presupposes that the signal levels in the left and right channels are in balance. If, however, one adjusts the volume of one channel so that it exceeds or is below that of the other, the resultant balancing out action becomes selective as to particular spatial positions; for acoustic cancellation will then be limited to those sonic frequencies which are equal in amplitude and in phase opposition. This makes possible selective manipulation of the sonic depth effect.

In practice, the outputs of the two stereo channels may be supplied to the matrix coupled to the drivers through separate cross-over networks of filters to select from the channel outputs a particular band of frequencies, such as the high frequency band, rather than passing the full frequency range into the matrix. This is useful in conjunction with speakers which do not have a flat frequency response, for it then becomes possible to contour the frequency response. It may also serve to tune or accentuate the response of the speakers to particular frequency bands in order to enhance depth perception; for, as pointed out previously, the ability of the ears to localize the direction of sound emanating from speakers is greater at some frequency bands in the range that at others.

While there has been shown and described a preferred embodiment of acoustic projection stereophonic system in accordance with the invention, it will be appreciated that many changes and modifications may be made therein without, however, departing from the essential spirit thereof.

I claim:

1. A system for acoustically projecting sounds into a listening chamber to substantially recreate the three-dimensional ambience of an original sound source composed of a central zone flanked by left and right zones, the sounds emanating from these zones being picked up by at least two microphones one adjacent the left zone and the other adjacent the right zone to produce signals which are conveyed by a stereophonic system in separate signal channels, said system comprising:

A. means coupled to said channels to extract therefrom a first power output derived from the sum of the channel signals; a second power output derived from the difference between the left and right signals, and a third power output derived from the difference between the right and left signals;

B. a reproducer array composed of a middle speaker flanked by left and right speakers;

C. means to apply said first power output to said middle speaker to energize same to project sounds from the front and rear thereof representing the sounds originating at all of said zones;

D. means to apply said second power output to said left speaker to energize same to project sounds from the front and rear thereof representing the difference between the sounds originating at the left and right zone;

E. means to apply said third power output to said right speaker to energize same to project sounds from the front and rear thereof representing the difference between the sounds originating at the right and left zones, and F a common cabinet including front, back and side walls and an open interior placeable within said listening chamber and having said array of speakers mounted therein in an arrangement in which said middle speaker is mounted on the back wall of the cabinet whereby the sound from the front of this speaker is projected toward the rear of the chamber, said left and right speakers being mounted on the corresponding side walls of the cabinet whereby the respective sounds from the fronts of these speakers are projected toward the corresponding side walls of the chamber, the front wall of the cabinet being defined by a baffle having a central port therein whereby the sounds from the rear of the speakers in the array are intermixed in the interior of the cabinet, and the resultant sound projected through said port toward the front of the chamber represents sound mainly originating at the central zone of said original sound source.

2. A system as set forth in claim 1, wherein said cabinet has a top wall with a port therein to permit sounds from the rear of the speakers in said array to be projected toward the ceiling of the chamber.

3. A system as set forth in claim 1, wherein said speakers are polarized dynamic speakers, each having a sound radiating cone and positive and negative input poles.

4. A system as set forth in claim 1, wherein said means to produce said power outputs is a mixer coupled to the output of a two-channel stereophonic amplifer having positive left and right channel output terminals L and R and a common ground terminal G, the mixer connecting the L and R terminals to the respective positive terminals of the left and right speakers and the G terminal to the negative pole of the middle speaker, the negative poles of the left and right speakers being connected to the L terminal whereby the signals from the left and right channels are applied in phase opposition to the left speaker and the signals from the right and left channels are applied in phase opposition to the right speaker, the positive pole of the middle speaker being connected to both the L and R terminals whereby the sum of the left and right channel signals are applied thereto.

5. A system as set forth in claim 4, further including first and second potentiometers wherein the positive pole of the middle speaker is connected to the L terminal through said first potentiometer and to the R terminals through said second potentiometer whereby the balance and relative level of the left and right signals applied to the middle speaker is adjustable.

6. A system as set forth in claim 4, further including a stereo receiver wherein the inputs to said stereophonic amplifier are left and right signals yielded by said stereo receiver.

7. A system as set forth in claim 4, further including a stereo player of recordings wherein the inputs to said stereophonic amplifier are left and right signals yielded by said stereo player of recordings.

8. A system as set forth in claim 3, wherein said means to produce said power outputs includes a two channel amplifier having left and right positive input and positive output terminals, incoming left and right stereophonic signals being applied to the right input terminal through a differential amplifier and to the left input terminal through a summing amplifier, the left output terminal being connected to the positive pole of the middle speaker whose negative pole is connected to the negative pole of the right speaker whose positive pole is connected to the negative pole of the left speaker whose positive pole is connected to the right output terminal.

* * * * *